United States Patent [19]

Quain

[11] Patent Number: 5,064,243

[45] Date of Patent: Nov. 12, 1991

[54] APPARATUS AND METHOD FOR USE IN HOSPITALS TO PROMOTE PATIENT-CAREGIVER CONTACT

[76] Inventor: Kay D. Quain, 221 Upper Valley Rd., North Wales, Pa. 19454

[21] Appl. No.: 561,796

[22] Filed: Aug. 2, 1990

Related U.S. Application Data

[63] Continuation-in-part of Ser. No. 336,428, Apr. 11, 1989, abandoned.

[51] Int. Cl.[5] ..... A47C 4/00

[52] U.S. Cl. ..... 297/58; 297/46; 182/156

[58] Field of Search ..... 297/55, 58, 30, 46, 297/47, 50; 182/33, 156, 160

[56] References Cited

U.S. PATENT DOCUMENTS

| | | | |
|---|---|---|---|
| 1,698,698 | 1/1929 | Hageman . | |
| 1,789,295 | 1/1931 | Bauer . | |
| 1,884,257 | 10/1932 | Ronk et al. . | |
| 1,939,596 | 12/1933 | Merrill . | |
| 2,103,874 | 12/1937 | Shwayder . | |
| 2,702,587 | 2/1955 | Wiegel | 297/46 |
| 2,948,332 | 8/1960 | Hamilton . | |
| 3,029,105 | 4/1962 | Junkunc | 297/58 X |
| 3,227,243 | 1/1966 | Bates et al. | 182/156 |
| 3,705,744 | 12/1972 | Piretti et al. . | |
| 3,836,194 | 9/1974 | Milette et al. . | |
| 3,936,907 | 2/1976 | Jansons . | |
| 4,440,264 | 4/1984 | Knoke et al. | 182/33 X |

FOREIGN PATENT DOCUMENTS

| | | | |
|---|---|---|---|
| 660289 | 3/1963 | Canada . | |
| 97733 | 1/1984 | European Pat. Off. | 182/156 |
| 662467 | 7/1929 | France . | |
| 1257779 | 2/1961 | France | 182/156 |
| 2445125 | 8/1980 | France . | |
| 0147202 | 3/1981 | German Democratic Rep. . | |

*Primary Examiner*—Laurie K. Cranmer

*Attorney, Agent, or Firm*—David J. Johns

[57] ABSTRACT

The present invention provides an apparatus and method to facilitate direct eye level contact between a hospital caregiver or other support personnel and a patient confined to a bed. The invention provides a lightweight yet stable chair which rapidly folds into a substantially flat unit which can be readily removed from the bedside in a medical emergency. The design of this apparatus makes it uniquely suitable for the severe constraints of a hospital environment.

18 Claims, 4 Drawing Sheets

APPARATUS AND METHOD FOR USE IN HOSPITALS TO PROMOTE PATIENT-CAREGIVER CONTACT

The present application is a continuation-in-part of copending U.S. patent application Ser. No. 336,428, filed Apr. 11, 1989, now abandoned.

BACKGROUND OF THE INVENTION

1. Field of the Invention

The present invention relates to method and equipment for use in a hospital environment, including hospitals and nursing homes. More particularly, the present invention is a method and apparatus for facilitating more direct contact between bed ridden patients and attending caregivers.

2. Description of The Prior Art

It is known that hospitalized patients confined to bed, particularly those seriously ill, have great difficulty carrying on direct face-to-face conversation with caregivers and other support persons. Although adjustable in height, hospital beds frames are typically maintained at a height of 32 to 38 inches; crib-type beds are often as high as 43 inches or more. With a six inch mattress, these heights extend to 38 to 49 inches. Traditional hospital rooms intentionally include sparse furnishings to allow for ease in rapidly reaching and treating a patient. Usually in this environment the only seat in the room is a sturdy chair of conventional height and solid construction which can be easily and reliably pushed out of the way without tipping in the case of an emergency. In practice these chairs are far too low to permit face-to-face conversation between the patient and the caregiver. Accordingly, hospital personnel rarely use these chairs and opt instead to stand at the foot or side of the bed—again making impossible eye-level conversation. This positioning results in the patient feeling removed and distant from the caregivers and support persons and adds to the detrimental isolation often felt in a hospital. Additionally, the fatigue of standing necessarily shortens the time the caregiver can spend with a patient.

The only consistently used means around this problem of lack of face-to-face conversation is for the caregiver to sit on the bed itself. Unfortunately, this is often difficult or impossible with the use of bed rails and various intravenous and monitor hook-ups. Additionally, it is not particularly comfortable for the patient or the caregiver.

Although seats of taller than normal height are known, they are not suitable for use in a hospital environment. Most such seats, such as bar stools, are constructed of heavy material and would be completely unsuitable for a hospital. These chairs would readily tip and create a tripping hazard in the case of a hospital emergency. Another possible response is to use a tall legged seat which folds into a somewhat compact unit, such as a "director's chair." However, these devices are still far too bulky and unwieldy for use in a hospital.

One such device is the step stool disclosed in U.S. Pat. No. 3,227,243 issued to Bates et al. This device, although providing a seat of apparently taller than average height, cannot be readily applied in a hospital environment. In addition to being of a non-disclosed height, the Bates et al. chair is deficient for use in this environment due to its overly heavy and bulky design and a restrictive folding means. The primary problems with the Bates et al. design of chair is its bulk and the fact that it does not fold completely into a flat unit which can be easily set aside in the case of an emergency. Additionally, the Bates et al. step stool is not designed to have an adequately comfortable seat and supportive back.

Another approach is to employ a relatively conventional chair with extended legs. One such device is shown in French Patent 2,445,125 to Mousset, which is a folding chair with adjustable legs, allowing the chair to be raised or lowered to various undisclosed heights. In addition to not folding completely flat, use of devices such as these have also proven unsuitable for a hospital environment.

It has been found that merely extending the legs of a conventional folding chair does not provide enough stability or structural integrity to withstand the demands of a hospital. A lack of stability compromises both the safety of the chair and the comfort of the caregiver; a lack of structural integrity makes the chair prone to breakage in the heavy use encountered in a hospital. However, the addition of further braces or supports to a long legged chair tends to restrict the crucial ease of collapsibility and to add undesirably to the overall weight of the chair.

It is accordingly a primary object of the present invention to provide a method and device for use in a hospital which facilitates and encourages eye-level face-to-face contact between a caregiver and a bed ridden patient.

It is a further object of the present invention to provide such a device which rapidly folds into a substantially flat and lightweight unit which does not present any hazard to hospital personnel in a medical emergency.

It is an additional object of the present invention to provide such a device which is comfortable to sit upon for an extended period of time and which is readily cleaned and capable of thorough sanitization.

SUMMARY OF THE INVENTION

The present invention provides an apparatus and method for use in a hospital environment to promote face-to-face eye-level contact of caregivers or support personnel to patients confined to bed.

The apparatus comprises a pivotal seat positioned 22 to 28 inches above the ground, pairs of front and rear legs connected intermediate their ends by fixed cross bars, a pivotal brace between cross bars for the front and rear legs, connected directly to the seat by a connecting rod so that the brace moves in unison with the seat, and a supportive back. The entire unit is very stable when open but is designed to fold flat rapidly and is easily removed from the bedside in the event of a medical emergency. The unit is constructed of easily cleaned material which can withstand the harsh disinfectants used in a hospital environment.

The present invention promotes direct patient contact without hindering the hospital staff with obstacles in the way of providing life-saving aid.

DETAILED DESCRIPTION OF THE INVENTION

The present invention provides a method and apparatus for use in hospitals which contributes to direct eye-level contact between a bed ridden patient and a caregiver or other support personnel. Although the term "hospital" is used throughout this description, it should be understood that in the present context this term is intended to include all forms of medical, nursing home, or similar institutional environments.

Figure 1:
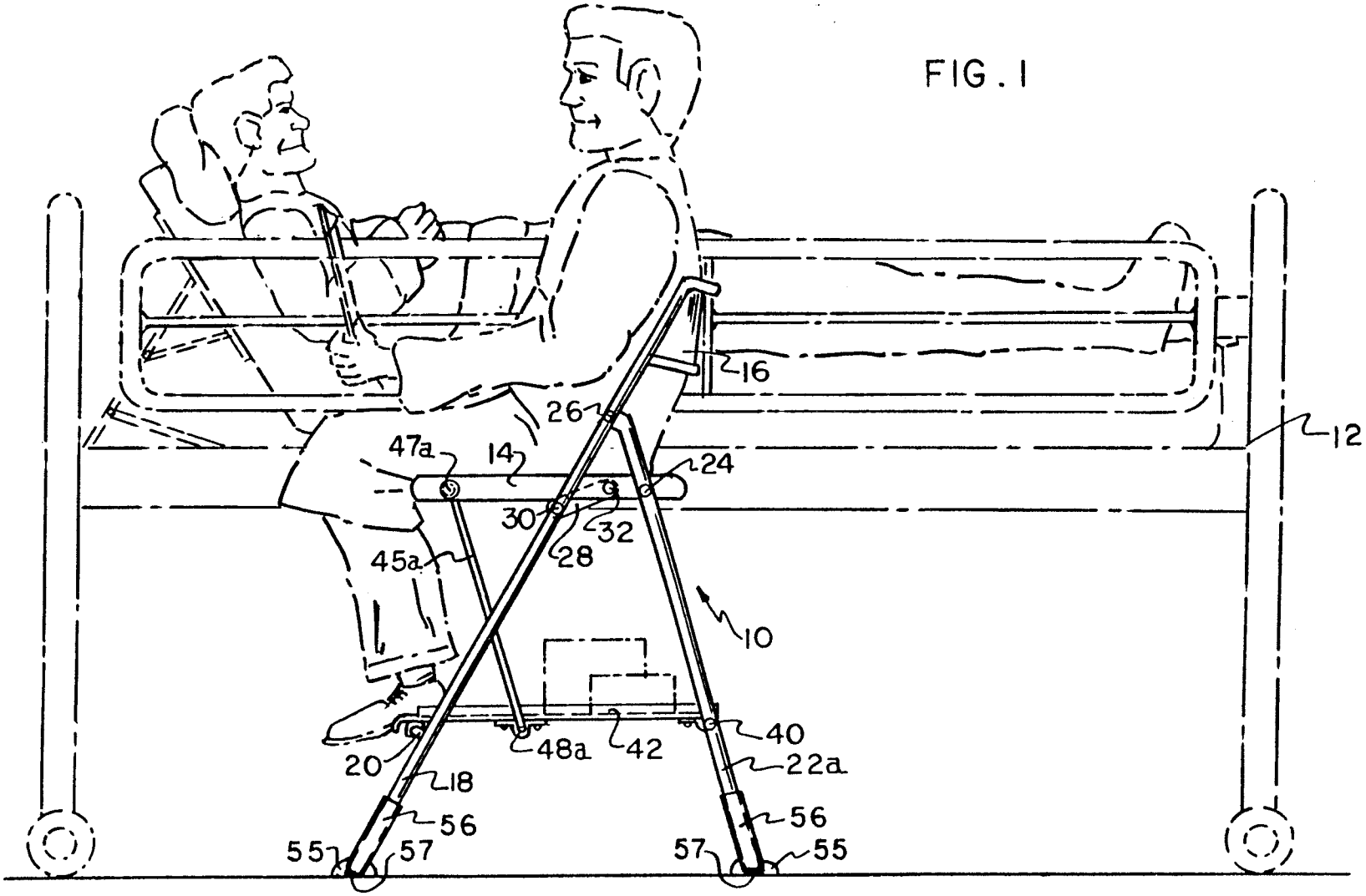
FIG. 1 is a side elevation of the apparatus of the present invention shown in relation to a typical hospital bed (in phantom)
Figure 5:
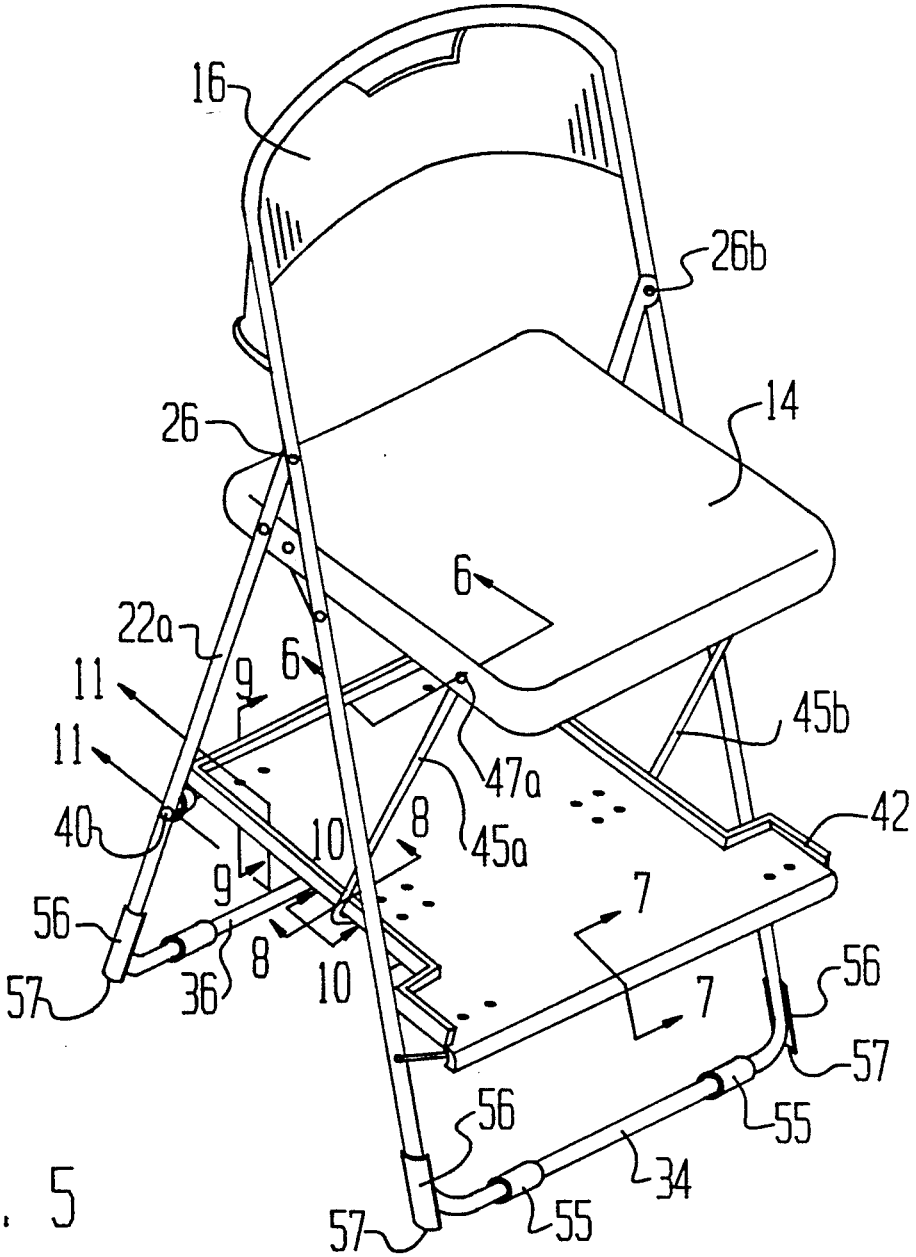
FIG. 5 is an isometric view of the present invention shown in the open position.

Shown in FIG. 1 is the apparatus 10 of the present invention shown in relation with a typical hospital bed 12 while FIG. 5 and accompanying FIGS. 6 through 11 show an isometric view of the chair in its operative position. The apparatus 10 comprises a seat 14, a back 16, two parallel elongated forward legs 18*a* and 18*b*, front transverse supporting bar 20 joining legs 18*a* and 18*b*, two parallel rear legs 22*a* and 22*b*, rear transverse support bar 40, and a pivotal brace 42 between the front support bar 20 and rear support bar 40.

Each rear leg 22*a* and 22*b* is joined to the seat 14 by a bolt 24, which provides a pivot point between the seat 14 and each rear leg 22*a* and 22*b*. Additionally, the rear legs 22*a* and 22*b* are joined to the front legs 18*a* and 18*b*, respectively, through bolts 26*a* and 26*b*, respectively. Again, each of bolts 26*a* and 26*b* provide a pivot point between rear legs 22 and front leg 18. The front legs 18*a* and 18*b* are each joined to the seat by a pivot arm 28, which attaches to the front legs 18 by pivoting bolt connection 30 and attaches to the seat 14 by pivoting bolt connection 32.

Figure 6:
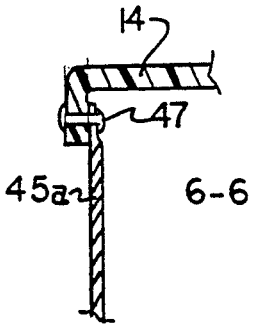
FIG. 6 is a vertical section taken on the line 6—6 of FIG. 5.

The pivotal brace 42 is connected to rear transverse support bar 40 by pivoting clamps 43*a* and 43*b*. Pivotal brace 42 is joined to seat 14 by connecting rods 45*a* and 45*b*. As is shown in FIG. 6, connecting rods 45 are attached to seat 14 by suitable pivotal means such as bolt 47. Connecting rods 45*a*, 45*b* are pivotally connected to tray 42 by suitable means such as channeled couplings 48*a* and 48*b*.

The structural integrity of the present invention may be greatly improved with minimal additional weight through use of a reinforcement bar 34 joining the front legs 18*a* and 18*b* at ground level and reinforcement bar 36 joining the rear legs 22*a* and 22*b* at ground level. To prevent the present invention from sliding, plastic or rubber attachments 55 can be added to the bottom of the bar 34.

It has further been found that greater stability of the chair can be achieved if leg extensions 56 are added to the outside bottom of the chair legs. These extensions 56, which may be constructed of materials such as metal or plastic, are permanently affixed to the outside of the legs through a known method such as welding or adhesive. A flexible end cap 57 of rubber or plastic may be added to the bottom of the extension 56 to prevent the chair from sliding. The addition of the extensions 56 are believed to significantly increase the stability of the chair as a whole while adding very little weight or complexity to the entire unit.

Figure 4:
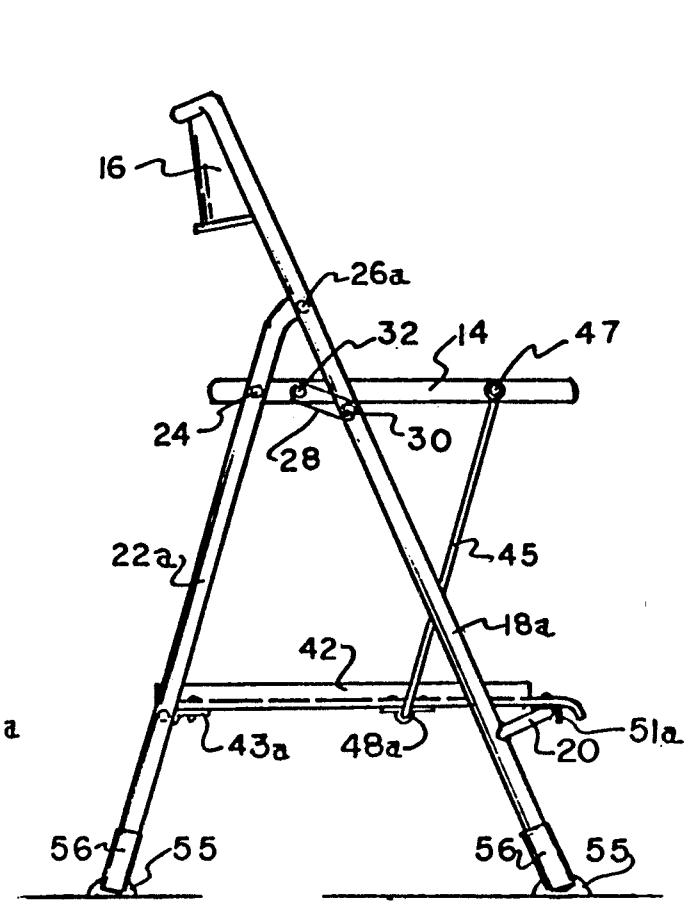
FIG. 4 is a side elevation of the present invention in its open position.
Figure 3:
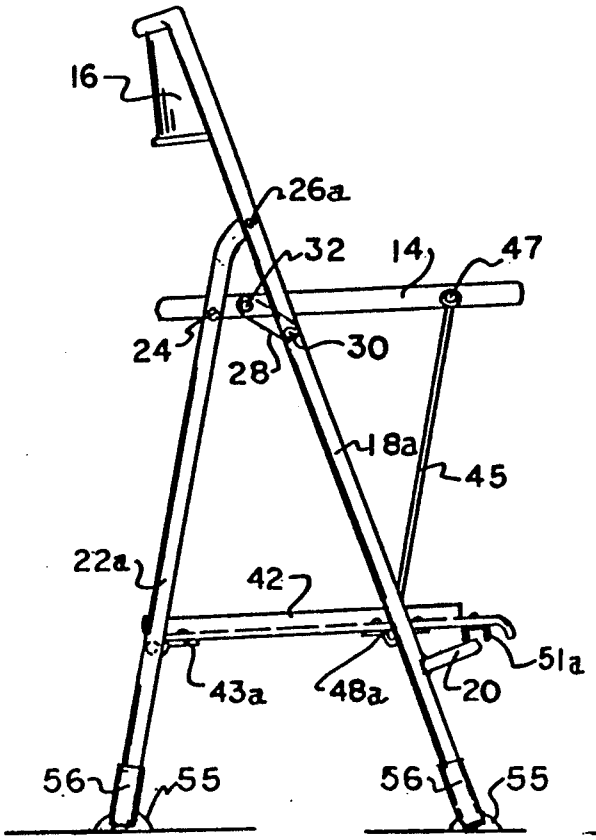
FIG. 3 is a side elevation of the present invention in a partially open position.

As shown in FIGS. 3 and 4, with present invention in its operative position, pivotal brace 42 is supported by and locked onto front transverse support rod 20 by releasably catches 51*a* and 51*b*. Pivotal brace 42 in the locked position serves to increase substantially the structural integrity of chair 10 by providing a solid connection between the front legs 18*a* and 18*b* intermediate their ends and rear legs 22*a* and 22*b* intermediate their ends. The pivotal brace 42 may also serve as a foot rest and, as a solid unit as shown, as a tray upon which to store objects during the use of chair 10. With the addition of raised edge 43, items stored on the brace 42 are prevented from sliding off.

In order to provide eye level contact between patients and support personnel, the seat of the present invention should be positioned 22 to 28 inches above the ground. The preferred embodiment shown is positioned at a height of 24 inches, within a preferred range of 23 to 25 inches. At this height it is crucial to have a foot rest to relieve strain on the caregiver's legs. Accordingly, the front support bar 20 and the pivotal brace 42 should be set at a height of 7 to 13 inches to serve as a suitable foot rest. Preferably, the brace 42 should be 9 inches above the ground.

The back 16 is preferably of a contoured shape and is 15 to 22 inches above the seat 14 to provide support for the caregiver's middle back.

Figure 2:
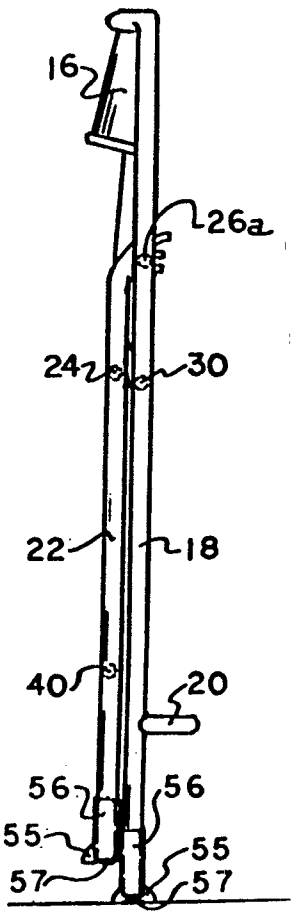
FIG. 2 is a side elevation of the present invention in its folded position.

As is shown in FIG. 2, the present invention folds into a substantially flat unit. This is accomplished by holding back 16 and raising seat 14. Pivoting around bolts 30 via extension arms 28, the seat 14 then actuated rear legs 22 forward until they are substantially parallel to the front legs 18. Since seat 14 is interconnected to the pivotal brace 42 through connecting rods 45*a* and 45*b*, raising the seat causes the pivotal brace 42 to swing automatically upwardly about channeled couplings 48*a* and 48*b* into a vertical position substantially parallel to the seat.

Figure 7:
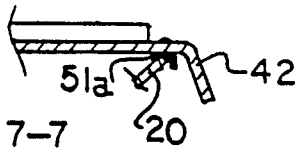
FIG. 7 is a vertical section taken on the line 7—7 of FIG. 5.
Figure 9:
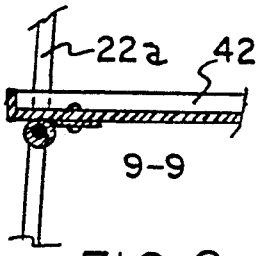
FIG. 9 is a vertical section taken on the line 9—9 of FIG. 5.
Figure 8:
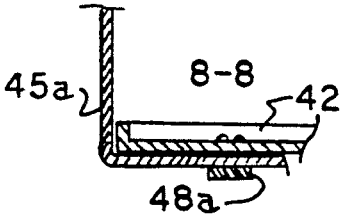
FIG. 8 is a vertical section taken on the line 8—8 of FIG. 5.
Figure 10:
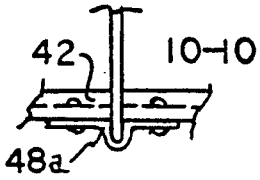
FIG. 10 is a vertical section taken on the line 10—10 of FIG. 5.

For the unit to fold quickly and easily, it is important that the catches 51*a* and 51*b* will disengage the front support rod 20 with minimal effort exerted on the seat 14. However, in order to achieve suitable structural integrity, the catches 51*a* and 51*b* should fit over the front support bar 20 snugly when the chair is fully open. To this end, it is believed that catches 51*a* and 51*b* should be constructed from a strong yet somewhat flexible material, such as semi-rigid polyvinyl chloride (PVC), extruded plastic, polyethylene, nylon, Delran®, high impact polystyrene, or stainless steel. Ideally, the catches 51*a* and 51*b* should be constructed of stainless steel and should be of a modified "C" shape, as is shown in FIGS. 3, 4, and 7.

The key to the proper operation of the apparatus of the present invention is that the catches 51 should firmly engage bar 20 when the chair is completely open. In this manner, the brace 42 holds the four legs 18*a*, 18*b*, 22*a*, 22*b* in set position relative to each other. The chair thus has significantly less sway and provides the necessary stability, even under heavy loads. Equally important is that the catches 51 should automatically disengage the bar 20 when the seat 14, connecting rods 45, and pivotal brace 42 are raised. Accordingly, the catches 51 should be of an open construction or of sufficient flexibility to allow them to disengage the bar 20 without difficulty.

Figure 11:
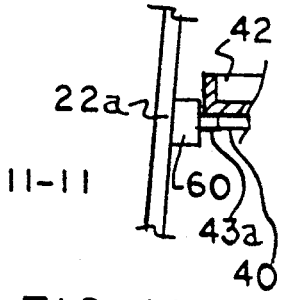
FIG. 11 is an enlarged sectional view of a rear leg of the present invention as shown in FIG. 5, showing the junction between the leg and a pivotal brace.

Additional stability may be achieved by limiting the movement of the pivotal brace 42 relative to the rear support bar 40. As is shown in FIG. 11, a spacer ring 60 may be provided on the rear support bar 40 on each side between the pivotal brace 42 and the rear legs 22. The ring 60, which may be made from metal, plastic, Teflon®, or other suitable material, should be proportioned to provide a snug fit for the pivotal brace 42 while providing enough space to allow the pivotal brace 42 to rotate freely with respect to the rear support bar 40. The ring 60 may also be formed as an integral portion of the pivotal brace 42 or the clamp 43.

The apparatus of the present invention may be constructed of any strong, lightweight material. However, it is viewed as quite important that the apparatus 10, particularly in its folded position, be easily removed from the bed side, preferably one-handed, in the event of a medical emergency. Accordingly, the weight of the entire unit should be no more than 160 ounces and preferably less than 150 ounces. Moreover, the entire apparatus 10 must be readily cleanable and capable of withstanding the harsh chemicals used to disinfect hospital equipment, such as bleach, alcohol, ammonia, detergents, and all other cleansers used in a medical environment. In order to meet these restrictions, materials such as high impact polystyrene, vinyl, formed metal (e.g. stainless steel, alloys, or aluminum) for the back 16 and seat 14, and painted steel tubing, plastic clad steel tubing, stainless steel tubing, aluminum tubing for the remainder of the apparatus 10 are preferred.

The apparatus 10 of the present invention provides a strong, stable, and comfortable means to promote direct eye-level contact between hospital patients and caregivers and other support personnel. This is believed to greatly enhance the important psychological aspects of the healing process. Even though the present apparatus is extremely lightweight, it is quite stable in its operational position and it folds completely flat very rapidly to allow it to be removed from the scene in a medical emergency.

In use the present invention is employed at the bed side of the patient in the hospital. As is shown in FIG. 1, the chair of the present invention is positioned at the bed side in such a manner that the patient and the caregiver may converse at substantially the same eye-level. It should be appreciated that most hospital beds are capable of being adjusted in height to some degree, and the present invention functions best if the height of the bed is adjusted if necessary to position the patient's and the caregiver's eye-levels at the same height. When the visit is concluded or in the case of an emergency situation, the chair of the present invention may then be readily collapsed into a flat unit and completely removed from the bed side.

While particular embodiments of the present invention are disclosed herein, it is not intended to limit the invention to such disclosure, and changes and modifications may be incorporated and embodied within the scope of the following claims.

What is claimed is:

1. A collapsible chair for use in hospitals for facilitating contact between patients confined to a bed and caregivers and support personnel which comprises:

a seat, a supportive back, front legs, rear legs, and a pivotal brace;

said seat being 22 to 28 inches high;

a front transverse support bar connecting said front legs intermediate their ends;

a rear transverse support bar connecting back legs intermediate their ends;

said seat pivotally connected to said rear legs;

said brace pivotally connected to said rear transverse support bar;

connecting rod means pivotally connecting said seat and said brace;

said brace being pivotal with said seat about their connections to the rear transverse support bar and the rear legs respectively, between a retracted position in which said seat, brace, and front and rear legs lie in a generally vertical plane, and an operative position in which said front legs are disposed forward of said rear legs, said seat is supported on said front legs, and said brace is supported on said front transverse support bar, said brace projecting forward of said transverse support bar.

2. A collapsible chair as set forth in claim 1 in which said brace has a top side and an underside, and the underside of said brace has a locking catch attached thereto for reception over said transverse support bar for releasably locking the brace in an operative position.

3. The apparatus of claim 2 wherein said locking catch comprises a C-shape and is constructed from flexible material which releasably engages said support bar.

4. A collapsible chair as set forth in claim 1 in which said brace provides a substantially solid surface so as to serve as a tray.

5. A collapsible chair as set forth in claim 4 in which the brace has a raised edge to assist in retaining items on it when in an operative position.

6. A collapsible chair as set forth in claim 5 in which the raised edge begins on one side of said brace and continues around the brace and ends on the opposite side of said brace.

7. The apparatus of claim 1 wherein said forward legs are joined at the floor level by a reinforcement bar.

8. A collapsible chair as set forth in claim 7 in which attached to the outside bottom of the legs are leg extensions to increase stability of the chair.

9. The apparatus of claim 1 wherein said rear legs are joined at the floor level by a reinforcement bar.

10. The apparatus of claim 1 wherein said supportive back comprises a contoured back oriented 15 to 22 inches above said seat.

11. The apparatus of claim 1 wherein the rod means connecting said seat and said brace comprises an essentially U-shaped unit connected at its upper ends to said seat by a pair of pivotal connections, and passing under said brace intermediate its ends; said brace held in relative position with the U-shaped rod by a channeled couplings attached to the brace and surrounding the U-shaped rod while permitting said rod to rotate within said channeled couplings.

12. The apparatus of claim 1 wherein said seat is oriented 23 to 25 inches high and said pivotal brace is oriented 7 to 13 inches high.

13. The apparatus as set forth in claim 1 wherein a spacer ring is provided on the rear support bar between the pivotal brace and the rear legs.

14. A method of promoting improved contact between a bed ridden patient and a caregiver in a hospital environment which comprises providing a chair for the caregiver, including a seat of between 22 and 28 inches in height and a footrest of between 7 and 13 inches in height;

positioning the chair and the hospital bed so to situate the caregiver and the patient at substantially the same eye-level relative to one another;

providing the chair with means to fold readily into a substantially flat unit which may be easily removed from the bed side;

wherein said means to fold the chair into a substantially flat unit includes said seat being supported on front and rear sets of legs, said front legs being joined intermediate their ends by a front support bar, said rear legs being joined intermediate their ends by a rear support bar, a pivotal brace being provided hingedly attached to one such support bar and removably attaching to the other said support bar, wherein the pivotal brace is attached to the seat so to cause it to actuate with the seat when the chair is folded.

15. A collapsible chair for use in hospitals for facilitating contact between patients confined to a bed and caregivers and support personnel which comprises:

a seat, a supportive back, front legs, rear legs, and a pivotal brace;

a front transverse support bar connecting said front legs intermediate their ends;

a rear transverse support bar connecting back legs intermediate their ends;

said seat pivotally connected to said rear legs;

said brace pivotally connected to said rear transverse support bar;

connecting rod means pivotally connecting said seat and said brace;

said brace being pivotal with said seat about their connections to the rear transverse support bar and the rear legs respectively, between a retracted position in which said seat, brace, and front and rear legs lie in a generally vertical plane, and an operative position in which said front legs are disposed forward of said rear legs, said seat is supported on said front legs, and said brace is supported on said front transverse support bar, said brace projecting forward of said front transverse support bar.

16. A collapsible chair as set forth in claim 15 in which said brace has a top side and an underside, and the underside of said brace has a locking catch attached thereto for reception over said front transverse support bar for releasably locking the brace in an operative position.

17. A collapsible chair as set forth in claim 16 in which said brace provides a substantially solid surface so as to serve as a tray.

18. The apparatus of claim 15 wherein the rod connecting said seat and said brace comprises an essentially U-shaped unit connected at its upper ends to said seat by a pair of pivotal connections, and passing under said tray intermediate its ends; said tray held in relative position with the U-shaped rod by a channeled couplings attached to the tray and surrounding the U-shaped rod while permitting said rod to rotate within said channeled couplings.

* * * * *